US006150767A

United States Patent [19]

Huang

[11] Patent Number: 6,150,767

[45] Date of Patent: Nov. 21, 2000

[54] COMMON DRIVING CIRCUIT FOR SCAN ELECTRODES IN A PLASMA DISPLAY PANEL

[75] Inventor: Jih-Fon Huang, Hsinchu, Taiwan

[73] Assignee: Acer Display Technology, Inc., Taiwan

[21] Appl. No.: 09/442,893

[22] Filed: Nov. 18, 1999

[30] Foreign Application Priority Data

Nov. 19, 1998 [TW] Taiwan ..... 87119141

[51] Int. Cl.[7] ..... G09G 3/28

[52] U.S. Cl. ..... 315/169.4; 315/169.3; 345/60

[58] Field of Search ..... 315/169.1, 169.2, 315/169.3, 169.4; 345/60, 63, 45

[56] References Cited

U.S. PATENT DOCUMENTS 3,765,011 10/1973 Sawyer et al. ..... 315/169 TV
4,139,803 2/1979 Kurahashi et al. ..... 315/169.4
5,446,344 8/1995 Kanazawa ..... 315/169.4
5,541,618 7/1996 Shinoda ..... 345/60

*Primary Examiner*—Don Wong
*Assistant Examiner*—Wilson Lee
*Attorney, Agent, or Firm*—Majestic, Parsons, Sievert & Hsue P.C.

[57] ABSTRACT

A plasma display panel (PDP) includes M address electrodes, N scan electrodes and N common electrodes orthogonal to the M address electrodes. The present invention is to provide with a common driving circuit for providing the N scan electrodes with a driving voltage. During a discharge sustain period of the PDP, the discharge sustain pulses pass through only essential function means rather than unnecessary function means in the common driving circuit, and thereby unnecessary power consumption occurring in the common driving circuit can be avoided. Low power consumption in the common driving circuit can reduce the heat accumulation in the PDP to assure the display quality of the PDP and alleviate the design regarding heat sink for the PDP.

11 Claims, 10 Drawing Sheets

COMMON DRIVING CIRCUIT FOR SCAN ELECTRODES IN A PLASMA DISPLAY PANEL

FIELD OF THE INVENTION

The present invention relates to a common driving circuit for scan electrodes of a plasma display panel (PDP), and more in particular, to a common driving circuit which has lower power consumption.

BACKGROUND OF THE INVENTION

A customary plasma display panel (PDP) device is composed of a display panel and a driving circuit. The PDP includes a plurality of discharge cells where each has three electrodes. The driving circuit is for driving the three electrodes of each discharge cell, respectively, in accordance with driving method and driving procedures. The three electrodes in each discharge cell include an address electrode (A-electrode) and two discharge sustain electrodes, respectively. The two discharge sustain electrodes can be distinguished into a scan electrode (Y-electrode) and a common electrode (X-electrode).

Some papers regarding driving circuit of the PDP are referenced herein and listed as follows: the U.S. Pat. Nos. 5,446,344 and 5,541,618.

Hereinafter, a prior art regarding PDP is disclosed. FIG. 1A shows a sectional diagram of a cell in a plasma display panel, and FIG. 1B schematically shows a structure (electrodes and n×m dots) of a plasma display panel. Note that FIG. 1A shows a cell forming a pixel at an intersection of the "i"th line (Yi) and "j"th column (Aj) of a surface discharge plasma display panel (PDP) having three electrodes shown in FIG. 1B.

In FIG. 1A, reference numeral 11 denotes a rear glass substrate, 12 denotes a dielectric layer, 13 denotes a MgO protective film, 14 denotes a front glass substrate, 15 denotes a fluorescent material (dielectric phosphor) deposited between the walls, 16 denotes a partition wall, and 17 denotes a discharge cavity. Further, reference mark Aj denotes an address electrode, and X and Yi denote sustain electrodes. Note that paired sustain electrodes X and Yi extend perpendicular to the plane of the figure.

As shown in FIG. 1A, sustain electrodes X and Yi are formed on the glass substrate 11 and is covered with the dielectric layer 12 for accumulating wall charges. The dielectric layer 12 is covered with the MgO protective film 13. The address electrode Aj extends in parallel with the plane of the figure and is formed on a glass substrate 14 that faces the glass substrate 11. The address electrode Aj is covered with a dielectric phosphor 15. The partition wall 16 is formed on the glass substrate 14 along a boundary of the pixel. The discharge cavity 17 is defined between the MgO protective film 13 and the phosphor 15. Penning mixtures such as Ne+Xe are sealed in the discharge cavity 17.

As shown in FIG. 1B, the PDP has "n×m" pixels with i=1 to n and j=1 to n. In order to turn ON and OFF a cell (pixel) formed at an intersection of an optional one of the sustain electrodes Yi and an optional one of the address electrodes Aj, the sustain electrodes Y1 to Yn are insulated from one another, and the address electrodes A1 to Am are insulated from one another. The sustain electrodes X extend in parallel with the sustain electrodes Y1 to Yn, respectively, and all of the sustain electrodes X are connected together with their one ends.

Present-day driving method of the PDP device usually divides a frame into eight sub-fields SF1 to SF8, as shown in FIG. 2. The ratio of the discharge sustain periods of the sub-fields SF1 to SF8 is 1:2:4:8:16:32:64:128 to realize 256 shades of gray. In FIG. 2, reference numerals 1 to N denote the discharge sustain electrodes Y1 to Yn.

If a screen is written at 60 Hz, a frame will be maintained for 16.6 microseconds. If one frame involves 510 discharge sustain cycles (each with two times of discharge), the numbers of discharge sustain cycles in the sub-fields SF1 to SF8 are 2, 4, 8, 16, 32, 64, 128, and 256, respectively. If the period of the discharge sustain is 8 nanoseconds, the total discharge sustain period in one frame will be 4.08 microseconds.

FIGS. 3A and 3B are to disclose a driving method of a three-electrode surface-discharge type PDP device. Like present-day driving method of the PDP device, the driving method also divides a frame into several sub-fields. In FIGS. 3A and 3B, (i), (ii) and (iii) are voltage waveforms applied to the address electrodes Aj, discharge sustain electrodes X and discharge sustain electrodes Yi, respectively, during the reset period and address period of one frame in accordance with the driving method.

In normal discharge cells, processes (a) and (b) completely neutralize wall charges or reduce them to an extent that no display errors occur due to the remnant wall charges. On the other hand, due to defects induced during the manufacturing of the PDP, some discharge cells may have abnormal properties to cause insufficient self-erase discharge and leave a large quantity of wall charges, or achieve no self-erase discharge, to leave wall charges accumulated by total write discharge as they are. These abnormal cells unnecessarily emit light during the discharge sustain period even with no address discharge. Accordingly, the driving method forcibly discharges and erases these wall charges before address discharge, to thereby prevent unnecessarily lighting during the discharge sustain period and improve the display quality of the PDP.

Next, during process (c), all electrodes are set to 0V, and a pulse of Vs is applied to the sustain electrodes Y1 to Yn. In response to this pulse, the discharge cells that hold a discharge sustain enabling quantity of negative wall charges on the sustain electrodes X relative to the sustain electrodes Yi cause discharge. This discharge may invert the polarity of the wall charges, to accumulate positive wall charges on the sustain electrodes X and negative wall charges on the sustain electrodes Yi. It is not always necessary to equalize the potential Vs with the potential of a sustain pulse during the discharge sustain period if the following equation (1) is satisfied:

$$Vsmin <= Vs < Vfxymin \quad (1)$$

where Vsmin is a minimum voltage at which all discharge cells in the PDP maintain discharge sustain, and Vxymin is a minimum discharge start voltage between the sustain electrodes X and Y1 to Yn.

During process (d), all electrodes are set to 0V, and a pulse of Va is applied to the sustain electrodes X and a pulse of −Vy to the sustain electrodes Y1 through Yn. The potential of this pulse is the same as that applied to the sustain electrodes X and Yi during the address period. This voltage must satisfy the following equation:

$$Vsmin <= Va + Vy < Vfxymin \quad (2)$$

In response to the pulse, the discharge cells in which a discharge enabling quantity of positive wall charges are accumulated on the sustain electrodes X relative to the sustain electrodes Y cause discharge. Due to this discharge, the polarity of the wall charges is inverted to accumulate negative wall charges on the sustain electrodes X and positive wall charges on the sustain electrodes Y.

The polarities of the remnant wall charges are integrated by the discharge of processes (c) and (d). In addition, the discharge in processes (c) and (d) uniformly distributes wall charges. The voltage of the next erase pulse is added to the wall charges, to adjust the quantity of the wall charges into one that is sufficient to discharge the wall charges.

During process (e), all electrodes are set to 0V, and an erase pulse 230 of Vs is applied to the sustain electrodes Y1 to Yn. This pulse gently rises. At the same time, a pulse of Vaw is applied to the address electrodes A1 to Am. This results in mostly erasing the wall charges even if a discharge start voltage varies from cell to cell. Only a small quantity of wall charges will be left. The remnant wall charges are positive opposite to the polarity of the next address pulse, to prevent unnecessary address discharge or lighting, thereby improving the display quality. The reason why the pulse of Vaw is applied to the address electrodes A1 to Am is to prevent unnecessary discharge between the sustain electrodes Y1 to Yn and the address electrodes A1 to Am.

Then, the address period starts. The address pulse of Va is continuously applied to the address electrodes A1 to Am. The scan pulse of −Vsc is continuously applied to the sustain electrodes Y1 to Yn. The sustain electrodes X are set to Va.

During process (f), the address electrodes A1 to Am are set to Vaw, and a sustain pulse of Vs is alternately applied to the sustain electrodes X and Y1 to Yn. The number of the sustain pulses is determined in accordance with the subfields actually needed.

FIG. 4 is an example of a three-electrode surface-discharge AC type PDP device which employs the plasma display panel of FIG. 1 and the aforesaid driving method. FIG. 4 is a block diagram showing the relationship between the plasma display panel and driving circuit. In FIG. 4, reference numeral 21 denotes a plasma display panel, 22 denotes a power source circuit, 23 denotes an address driver, 24 denotes a Y-common driver, 25 denotes a scan driver, 26 denotes an X-common driver, and 27 denotes a control circuit.

The display panel 21 has a first glass substrate on which address electrodes A1 to Am are arranged in parallel. A second glass substrate faces the first glass substrate and holds sustain electrodes X and Y1 to Yn that are orthogonal to the address electrodes A1 to Am. The sustain electrodes X form pairs with the sustain electrodes Y1 to Yn. All of the sustain electrodes X are connected together with their one ends.

As shown in FIG. 4, the power source circuit 22 generates voltages which are applied to the electrodes through the address driver 23, Y-common driver 24, scan driver 25, and X-common driver 26. The address driver 23, Y-common driver 24, scan driver 25, and X-common driver 26 are controlled in response to signals provided by the control circuit 27. Note that the control circuit 27 generates these signals according to externally supplied display data DATA (under resolution of 8-bit and 256 shades of gray), a dot clock signal CLOCK synchronous to the display data DATA, a vertical synchronous signal VSYNC, and a horizontal synchronous signal HSYNC.

The address driver 23 has a shift register 231 having a serial data input end for receiving serial display data from the control circuit 27, a clock input end for receiving a shift pulse from the control circuit 27, a latch circuit 232 for latching parallel display data stored in the shift register 231 after the shift register 231 secures display data for a line, and an address electrode drive circuit 233 to be turned on or off in response to an output of the latch circuit 232 and to provide a drive voltage in response to a control signal from the control circuit 27. The address electrode drive circuit 233 has m output ends connected to the address electrodes A1 to Am, respectively.

The scan driver 25 has a Y-drive circuit 251 distinguished into N Yi-drive circuit **251*i* which are arranged into a serial data input end for receiving "1" in synchronism with the start of an address period in each sub-field. The Y-drive circuit 25 has a clock input end for receiving a shift pulse synchronous to an address cycle. The scan driver 25 also has a Y-drive circuit 252 that is turned ON or OFF in response to output bits from the Y-drive circuit 251 and provides a drive voltage in response to a control signal from the control circuit 27. The Y-drive circuit 252 is distinguished into N Yi-drive circuits 252*i* which each has output ends connected to the sustain electrodes Y1 to Yn, respectively. The Y-common driver 24 provides a common drive voltage to the sustain electrodes Y1 to Yn through the Y-drive circuit 252. Note that, in FIG. 4**, potential Vcc is provided for logic circuits, and potential Vd is provided for drive circuits.

At present, there are many problems desirable to be solved for the PDP device, e.g., enhancement of luminous efficiency, lowering of manufacturing cost, improvement of driving method, lowering of power consumption, and so on, special for lowering of power consumption. It is well known that the power consumed by the PDP device mostly converts into heat, and that the converted heat will affect significantly display quality of the PDP device. The current research for display panels gravitate towards flat display panels. Therefore, the study regarding heat sink lowering of power consumption of the PDP device becomes important more and more.

Accordingly, an objective of the invention is to improve the driving circuit of the PDP device, and in particular, to improve the scan driving circuit which is a complicated part in the driving circuit of the PDP device. The improvement of the scan driving circuit is to lower power consumption thereof, and to further assure the display quality of the PDP device. The details and shortcomings of the driving circuit of the PDP device, according to the prior art, will be further set forth in the analysis of the prior art.

ANALYSIS OF THE PRIOR ART

Referring to FIG. 5, FIG. 5 is a circuit diagram showing the details of the Y-common driver 24 and Yi-drive circuits **252*i* of the Y-drive circuit shown in FIG. 4**.

In FIG. 5, the switch elements SW1, SW2, SW4, SW6, SW7, and SW9 are nMOS transistors, and the switch elements SW3, SW5, and SW8 are pMOS transistors. A diode is reversely connected between the source and drain of each of the MOS transistors. This diode serves as a MOS transistor protective diode. A resistor is connected between the gate and source of each of the MOS transistors of the switch elements SW3, SW4, SW5, and SW7. This resistor is a leak resistor for the gate potential. A Zener diode is connected to the resistor in parallel, to define a gate-source voltage to turn ON the MOS transistor.

In general, the switch elements must be switched rapidly, and thus MOS drivers are employed for driving the MOS transistors. In FIG. 5, reference marks M1 to M5 are MOS driver ICs (for example, MIC4428 produced by Micrel Inc.) that are usually used for PDP driving circuits, to generate a gate voltage Vgs for turning ON MOS transistors to be driven. The gate voltage Vgs provides pulses through a capacitor. A reference mark M6 is also a MOS driver IC (for example, IR2110 produced by IR company) whose output ends are connected to the switch elements SW1 and SW2, to form a push-pull circuit loop. The circuit loop is formed along following path: started from the M6-VS output terminal, the switch SW6, the signal line SU, diode D6, diode D5, signal line SD, and terminated at the switch SW1. With regard to the design of PDP with large size, it usually makes use of connecting several MOSFETs in parallel in the Y-common driver to reduce the output resistance. For example, one MIC4428 chip has a ON resistance of 0.55 Ω between its drain and source ($R_{DS(ON)}$), and two MIC4428 chips, connected in parallel, with a total resistance ($R_{Total}$) of 0.275 Ω are usually used in the Y-common driver of the PDP.

A reference mark M7 is a three-terminal regulator for generating a floating voltage of 5V (F.Vcc) for the Yi-drive circuit 252*i* according to potential Vd accumulated in a capacitor on the input I side. Because the voltage levels of potential Vss in the Y-common driver 24 are Vs, −Vy and 0V, respectively, the potential Vcc has three kinds of voltage levels: Vs+5V, −Vy+5V and +5V.

According to operational function, the Y-driver 24 of FIG. 5 can be distinguished into six circuit blocks (BLOCK1 to BLOCK6). The circuit block BLOCK1 is for providing each of the N scan electrodes (Yi-electrode) with a sustain pulse. The circuit block BLOCK5 is for generating the floating voltage of 5V for the Yi-drive circuit 252*i*. The circuit block BLOCK1 is for providing the Yi-drive circuit 252*i* with a working voltage during the scan period. The circuit block BLOCK2 is for providing the Yi-drive circuit 252*i* with a negative voltage during the reset period. The circuit block BLOCK4 is for providing the Yi-drive circuit 252*i* with a gently rising erase pulse during the reset period. The circuit block BLOCK3 has two functions: (1) the scan firing voltage source for providing the Yi-drive circuit 252*i* with a firing voltage during the scan period; and (2) the switch circuit (GATE) to disconnect the circuit loop via the switch SW6. A first output terminal of the circuit block BLOCK6 is electrically connected to the Yi-drive circuit 252*i* via a first line SU. A second output terminal of the circuit block BLOCK6 is electrically connected to the Yi-drive circuit 252*i* via a second line SD.

Hereinafter, the cause that the Y-common driver 24 is a circuit with high power consumption will be explained. Referring the driving method shown in FIG. 3 and the circuit shown in FIG. 5, the power consumed by the Y-common driver 24 is mostly consumed during the discharge sustain period. Moreover, the sustain pulses are applied to the Yi-drive circuit 252*i* through the circuit blocks BLOCK6 and BLOCK3. Clearly, the power consumed by the Y-common driver 24 can be consider as that consumed by the circuit blocks BLOCK6 and BLOCK3 during discharge sustain period.

The power consumed by the circuit blocks BLOCK6 and BLOCK3 can be calculated by the following equation:

$$P_{Loss}=I_{Peak}^2\times R_{Total} \tag{3}$$

where $P_{Loss}$ is the power consumed by the circuit blocks, i.e., the heat power generated by the circuit blocks; $I_{Peak}$ is the peak value of current flowing through the circuit blocks during the discharge sustain period; and $R_{Total}$ is the total output resistance of the circuit blocks. Therefore, the power consumed by the circuit blocks can be easily estimated only by measuring the peak value of current through the circuit blocks.

However, the physical quantities of power and current both are functions of time. The power consumed by one frame overall can not be presented only by the power consumed during the discharge sustain periods. Moreover, the power consumed by the circuit blocks depends on the waveforms of the discharge pulses. Therefore, the equation (3) for calculating the power consumed by the circuit blocks must be corrected by multiplying by a time ration and a discharge duty. The power consumed by the circuit blocks is calculated by the following equation:

$$P_{Loss} = I_{Peak}^2 \times R_{Total} \times \frac{\text{all sustain discharge periods in one frame (time)}}{\text{one frame (time)}} \times \text{discharge duty} \tag{4}$$

Hereinafter, the time ratio between all discharge sustain periods in one frame and one frame will be explained. Current driving method of the PDP device are by dividing one frame into several sub-fields, as shown in FIG. 2. Taking a PDP device, with the resolution of 8-bit and 256 shades of gray, as an example, one frame displayed by the PDP device is usually divided into 8 sub-fields. If a screen is written at 60 Hz, a frame will be maintained for 16.6 microseconds. In this case, one frame involves 510 discharge sustain cycles (each cycle with two times of discharge), the numbers of discharge sustain cycles in the first to eighth sub-fields are 2, 4, 8, 16, 32, 64, 128, and 256, respectively. In the aforesaid driving method, the period of one discharge sustain cycle is 8 nanoseconds, and thus the total discharge sustain period in one frame is 4.08 microseconds. The time ratio between all discharge sustain periods in one frame and one frame is 4.08 microseconds/16.6 microseconds about equal to ¼.

The estimation of the peak value of current $I_{peak}$ and discharge duty arc described in FIG. 6 which is a diagram schematically showing the discharge pulses caused by the discharge sustain pulses flowing through the Yi-electrode. In FIG. 6, (i), (ii) and (iii) are the discharge sustain pulses (voltage), the discharge pulses (current) on the Yi-electrode when the Yi-electrode is turned on, and the discharge pulses (current) on the Yi-electrode when the Yi-electrode is not turned on, respectively. As described previously, during the discharge sustain period, the Yi-electrode discharges twice at each of the discharge sustain cycle, i.e., the Yi-electrode respectively discharges at the rising edge and falling edge of one discharge sustain cycle. Clearly, as shown in FIG. 6, the amplitudes of the discharge pulses on the Yi-electrode when the Yi-electrode is turned on are larger than those of the discharge pulses on the Yi-electrode when the Yi-electrode is not turned on.

The current flowing through the circuit blocks is not easy to be measured. Comparatively, the current flowing through the Yi-electrode is easy to be measured. Clearly, as shown in FIG. 6, each of the discharge pulses has a current peak equal to that flowing through the circuit blocks connected with the Yi-electrode in series.

As shown in FIG. 6, the discharge duty is the ratio between the area integrated by two discharge pulses and the area formed by multiplying the discharge sustain period by the current peak. The discharge duty is determined by the practical design of the driving circuit of the PDP device. According to the embodiment of the invention, the discharge duty regarding one discharge sustain cycle with a period of 8 nanoseconds is ⅕.

Hereinafter, an example will be taken to estimate the high power consumed by the circuit blocks BLOCK6 and BLOCK3 in FIG. 5. Taking a PDP device with 852×480 pixels as an example, the Y-common driver 24 provides 120 lines of scan electrodes (Yi-electrodes) with a sustain pulse of Vs. The power consumed by the circuit blocks BLOCK6 and BLOCK3 depends on the driving condition of each Yi-electrode. Herein, to further explain, the power consumption regarding two special conditions, that are all-dark screen (lowest power consumption) and all-bright screen (highest power consumption) will be estimated.

When the screen is all dark, the current peak of the sustain pulse through each Yi-electrode is 50 mA by measuring, and thus the current peak through the circuit block BLOCK6 is equal to 24 A (50 mA×240). The total resistance $R_{Total}$ of the circuit block BLOCK6 is 0.275 Ω, so according to the equation (4) the power consumed by the circuit block BLOCK6 can be calculated as follows:

$$P_{Loss}=(24\text{ A})^2\times 0.275\ \Omega\times\tfrac{1}{4}\times\tfrac{1}{5}\cong 2\text{ W}$$

In FIG. 5, the circuit block BLOCK3 connects with the circuit block BLOCK6 in series, and the total resistance of the circuit block BLOCK3 is also 0.275 Ω. Clearly, the power consumed by the circuit block BLOCK3 is equal to that consumed by the circuit block BLOCK6 and is equal to about 2 W. Because the power consumed by the Y-common driver 24 is mostly equal to that consumed by the circuit blocks BLOCK6 and BLOCK3 during discharge sustain period, the power consumed by the Y-common driver 24 is equal to about 4 W when the screen is all dark.

When the screen is all bright, the current peak of the sustain pulse through each Yi-electrode is 150 mA by measuring, and thus the current peak through the circuit block BLOCK6 is equal to 72 A (50 mA×240). The total resistance $R_{Total}$ of the circuit block BLOCK6 is 0.275 Ω, so according to the equation (4) the power consumed by the circuit block BLOCK6 can be calculated as follows:

$$P_{Loss}=(72\text{ A})^2\times 0.275\ \Omega\times\tfrac{1}{4}\times\tfrac{1}{5}\cong 16\text{ W}$$

When the screen is all bright, the circuit block BLOCK3, connected with the circuit block BLOCK6 in series, has total resistance of 0.275 Ω and consumes power of about 16 W. Because the power consumed by the Y-common driver 24 is mostly equal to that consumed by the circuit blocks BLOCK6 and BLOCK3 during discharge sustain period, the power consumed by the Y-common driver 24 is equal to about 32 W when the screen is all dark.

As described above, for the example of the PDP device with 852×480 pixels, the Y-common driver 24 in FIG. 5 consumes the power of about 4 W (at all-dark screen) to 32 W (at all-bright screen). On analysis, the power consumed by the circuit block BLOCK6 is inevitable in the Y-common driver 24. However, the circuit block BLOCK3 connects with the circuit block BLOCK6 in series so that the current occurring during the discharge sustain period also flows through the circuit block BLOCK3. Clearly, the power consumed by the circuit block BLOCK3 is unnecessary.

SUMMARY OF INVENTION

A three-electrode surface-discharge AC-PDP device includes M address electrodes and N scan electrodes and common electrodes orthogonal to the M address electrodes. The invention is to provide the N scan electrodes with a common driving circuit (Y-common drive circuit) for providing each scan electrodes with a driving voltage.

The common driving circuit of the invention and N first scan driving devices and N second scan driving devices make up a scan driving circuit for driving the N scan electrodes. Each first scan driving device corresponds to one of the N scan electrodes. Each first scan driving device has a first terminal and a second terminal. A negative voltage is applied to the first terminal and rising erase pulses is applied to the second terminal during a reset period of the PDP. A working voltage is applied to the first terminal and a firing voltage is applied to the second terminal during a scan period of the PDP. The common driving circuit is for providing a driving voltage, via one first scan driving device, to one corresponding scan electrode. The PDP also includes a control circuit. The control circuit outputs a control signal, via one second scan driving circuit, to one corresponding first driving circuit to switch on and off the corresponding first driving circuit.

Each second scan driving device is electrically connected to one corresponding first driving scan device and one corresponding scan electrode. Each second scan driving device, responsive to an output signal from the corresponding first driving device, switches on and off. The common driving circuit is connected to each second scan driving device, respectively. The common driving circuit provides each scan electrode with the driving voltage via the second scan driving device corresponding to the scan electrode.

The common driving circuit includes a gate circuit and six circuit blocks (first to sixth circuit blocks, BLOCK1~BLOCK6). The gate circuit has a first terminal and a second terminal. The first terminal of the gate circuit is electrically connected to the first terminal of each first scan driving device. The first circuit block is for providing each first scan driving device with the working voltage during the scan period at an output end thereof. The output end of the first circuit block is coupled to the first terminal of the gate circuit. The second circuit block is for providing each first scan driving device with the negative voltage during the reset period at an output end thereof. The output end of the second circuit block is coupled to the first terminal of the gate circuit. The third circuit block BLOCK3 is for providing each first scan driving device with the firing voltage during the scan period at its output end. The output end of the third circuit block is coupled to the second terminal of the first driving device. The fourth circuit block is for providing each first scan driving device with the rising erase pulses during the reset period at an output end thereof. The output end of the fourth circuit block is coupled to the second terminal of each first scan driving device. The fifth circuit block is for generating a floating voltage to each first scan driving device. The sixth circuit block (BLOCK 6) is for providing discharge sustain pulses, via the gate circuit, to each first scan driving device during a discharge sustain period of the PDP. A first output terminal of the sixth circuit block is electrically connected to the second terminal of the gate circuit, and a second output terminal of the sixth circuit block is electrically connected to the second terminal of each first scan driving device. The gate circuit separates the firing voltage from the working voltage during the scan period.

In the common driving circuit of the invention, the discharge pulses flow through only essential circuit blocks during a discharge sustain period, and thereby unnecessary power consumption can be avoided. Due to low power consumption, the common driving circuit according to the invention can reduce the heat accumulation in the PDP device to assure the display quality of the PDP device and to alleviate the design regarding heat sink for the PDP device.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1A:
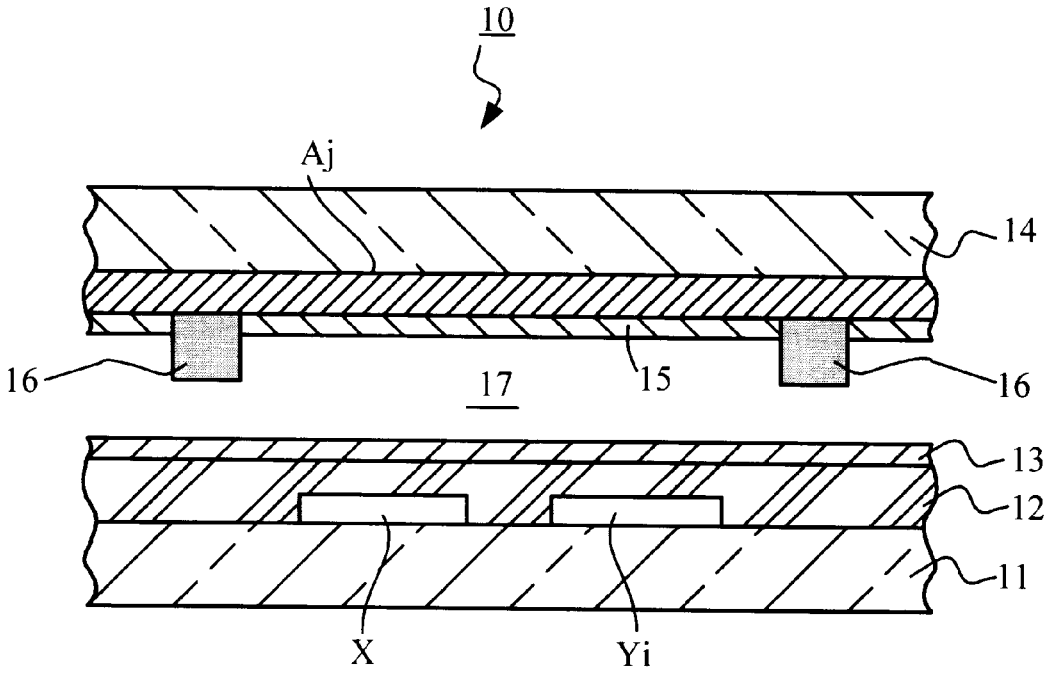
FIG. 1A (prior art)
FIG. 1A is a sectional diagram showing a discharge cell in a PDP of a prior art.
Figure 1B:
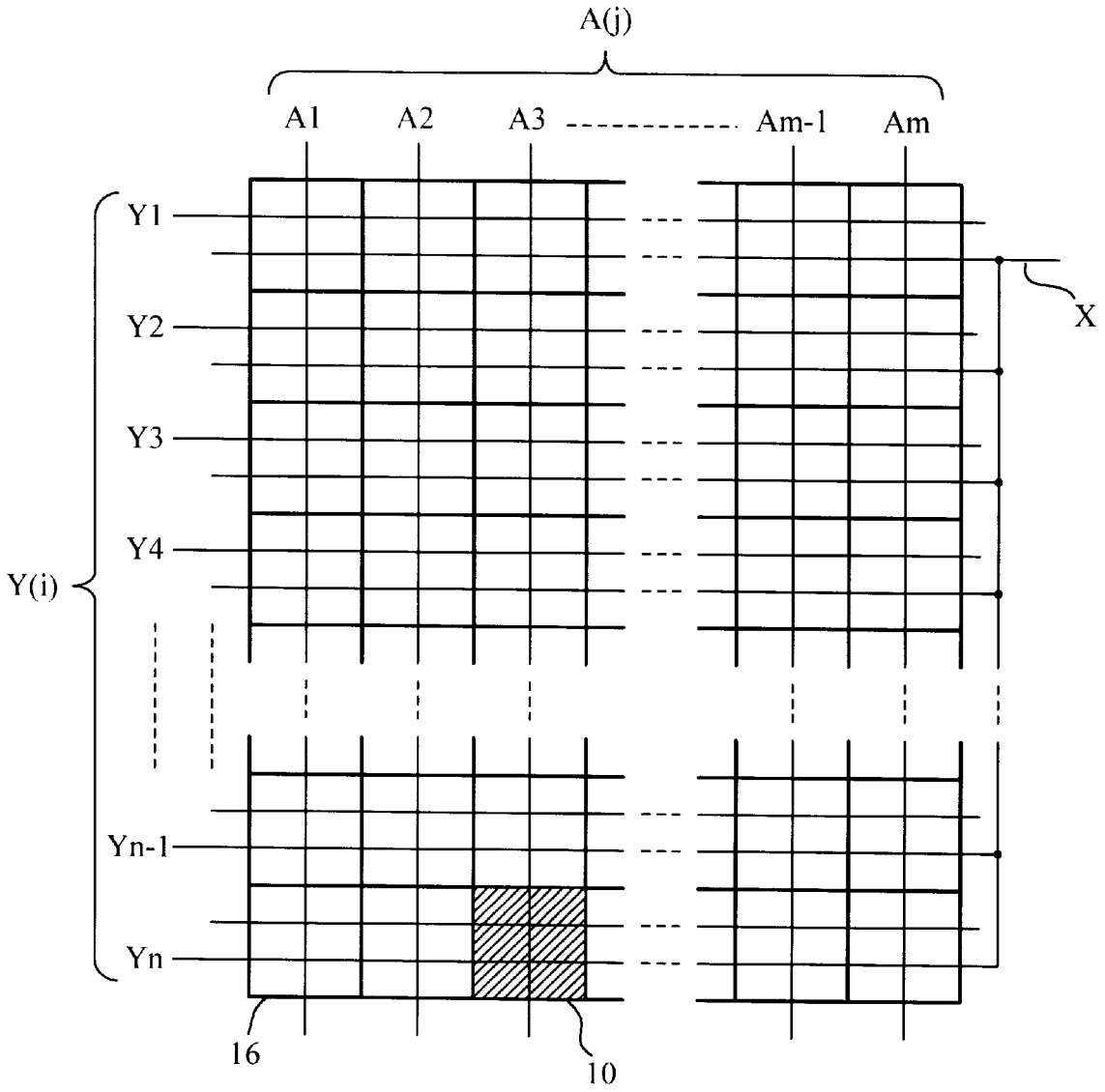
FIG. 1B (prior art)
FIG. 1B is a diagram schematically showing electrode structure of a PDP of a prior art.
Figure 2:
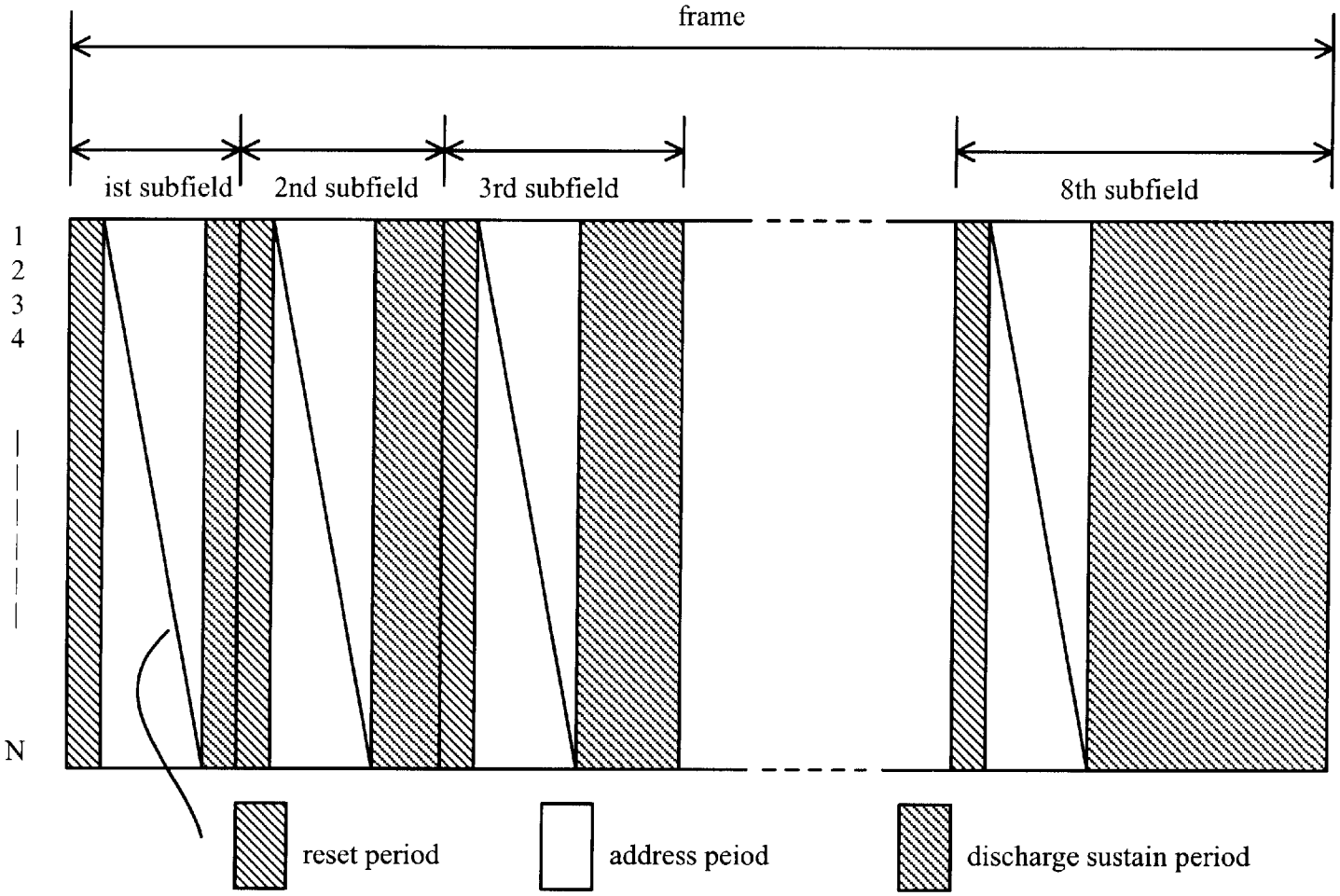
FIG. 2 (prior art)
FIG. 2 is a diagram showing a method of dividing a frame into several sub-fields.
Figure 3A:
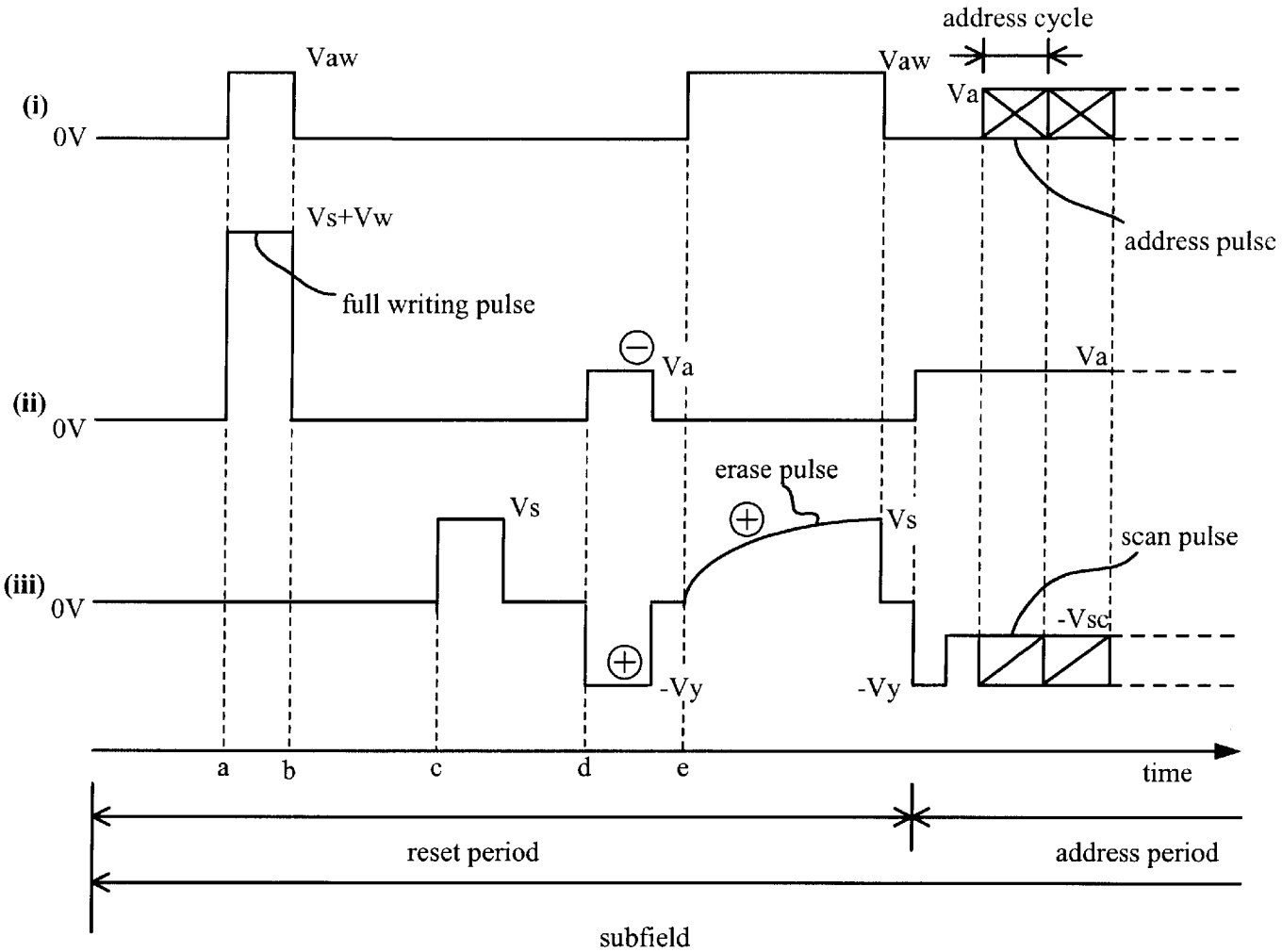
FIG. 3A (prior art)
FIGS. 3A and 3B are diagrams disclosing a method of driving a PDP device.
Figure 3B:
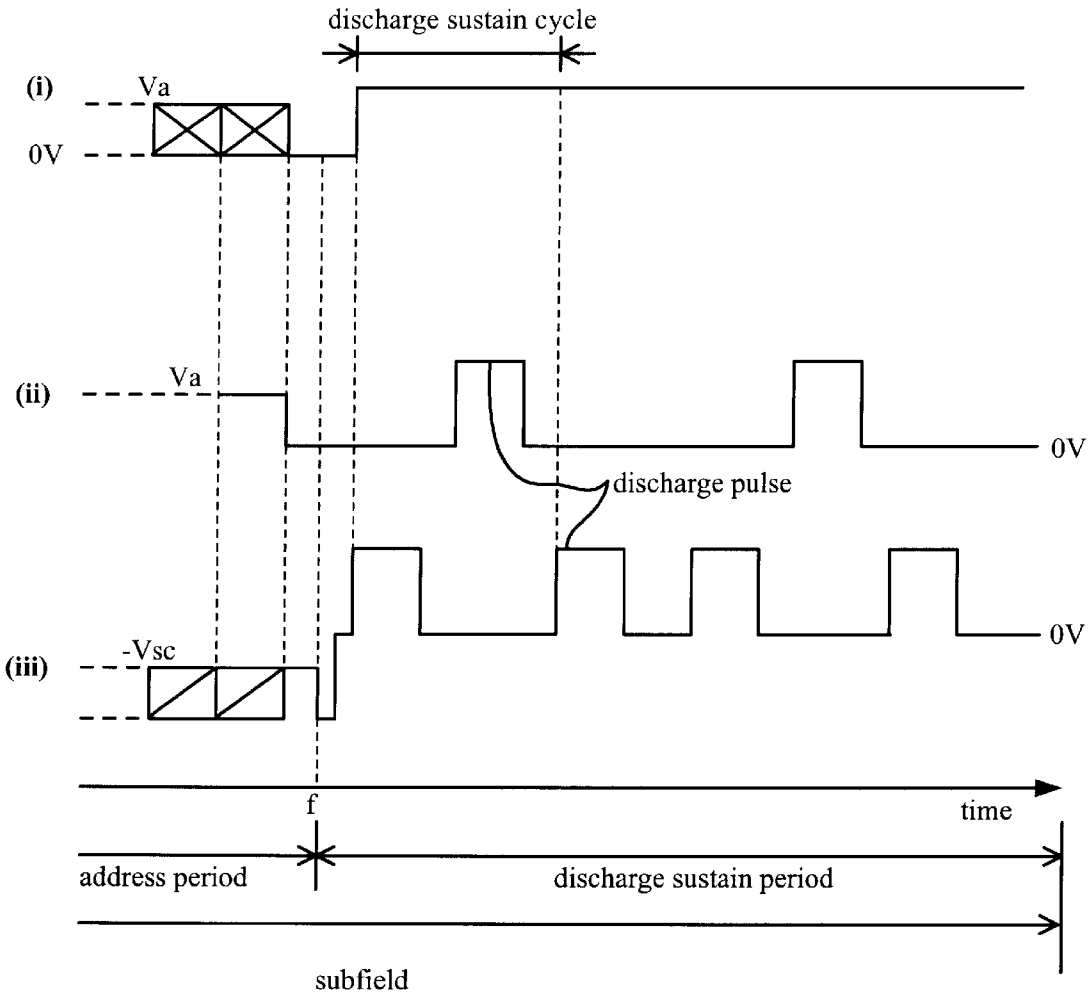
FIG. 3B (prior art)
Figure 4:
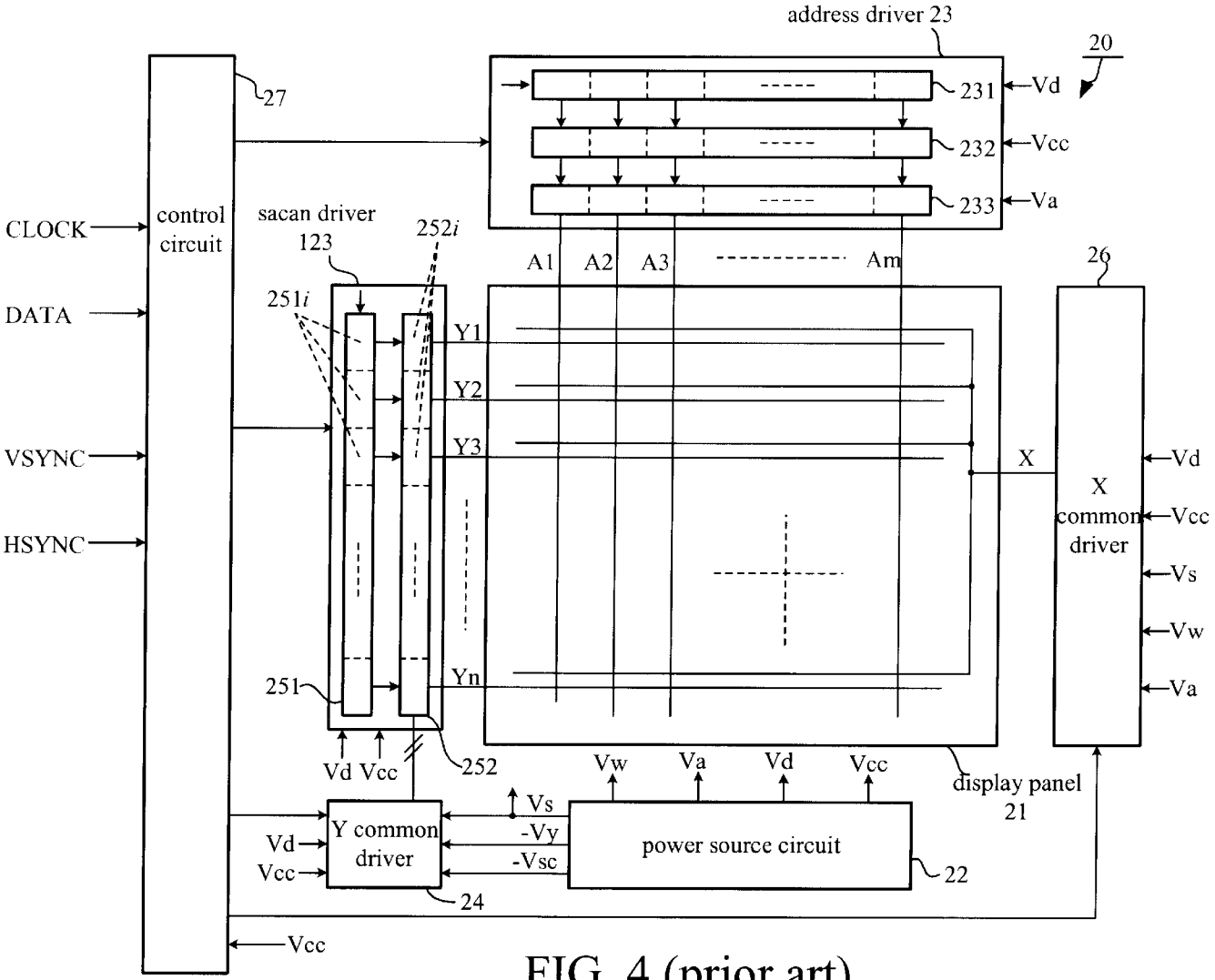
FIG. 4 (prior art)
FIG. 4 is a circuit diagram disclosing a driving circuit of a PDP according to the method of FIGS. 3A and 3B.
Figure 5:
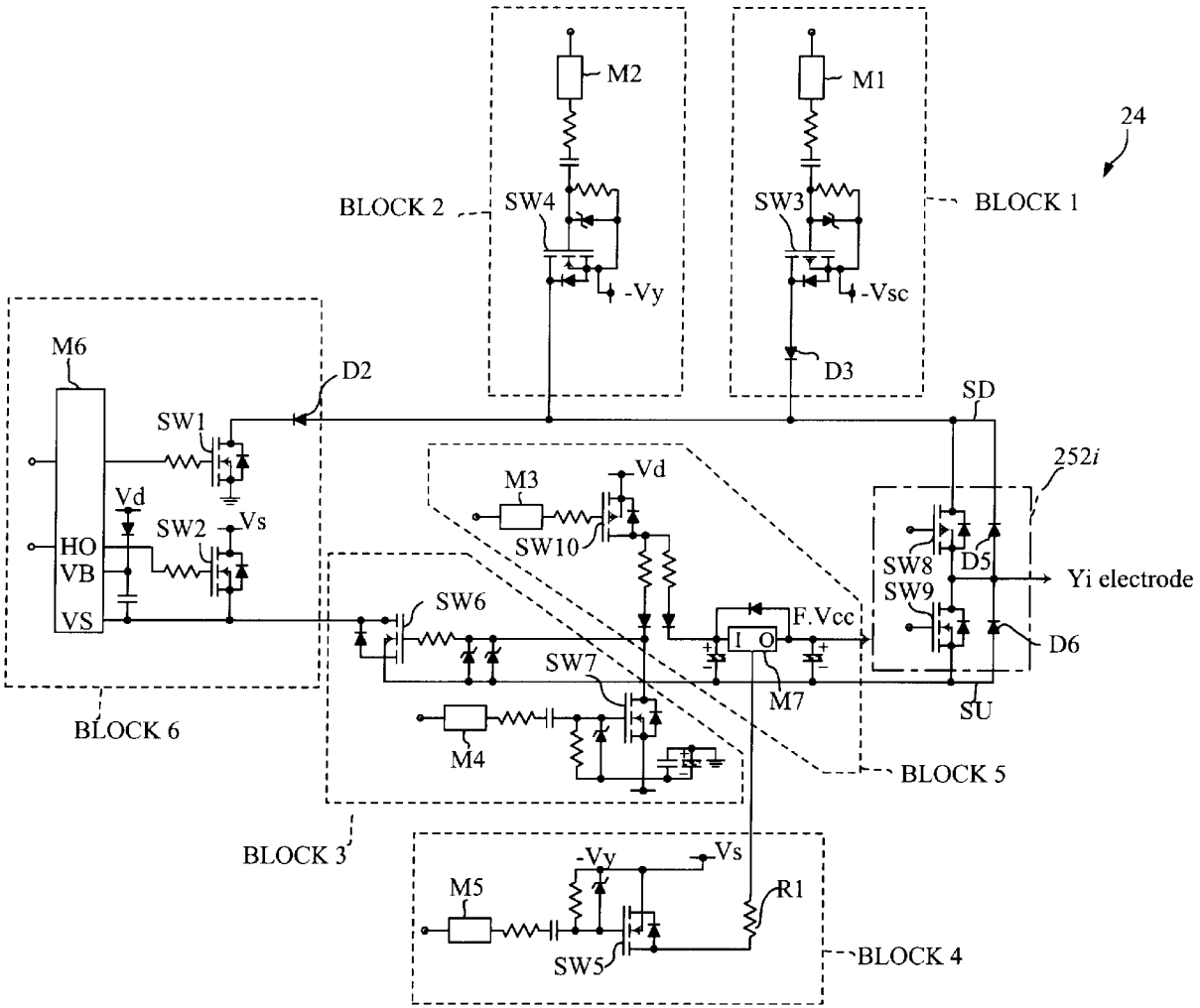
FIG. 5 (prior art)
FIG. 5 is a circuit diagram showing the details of the Y-common driver of FIG. 4.
Figure 6:
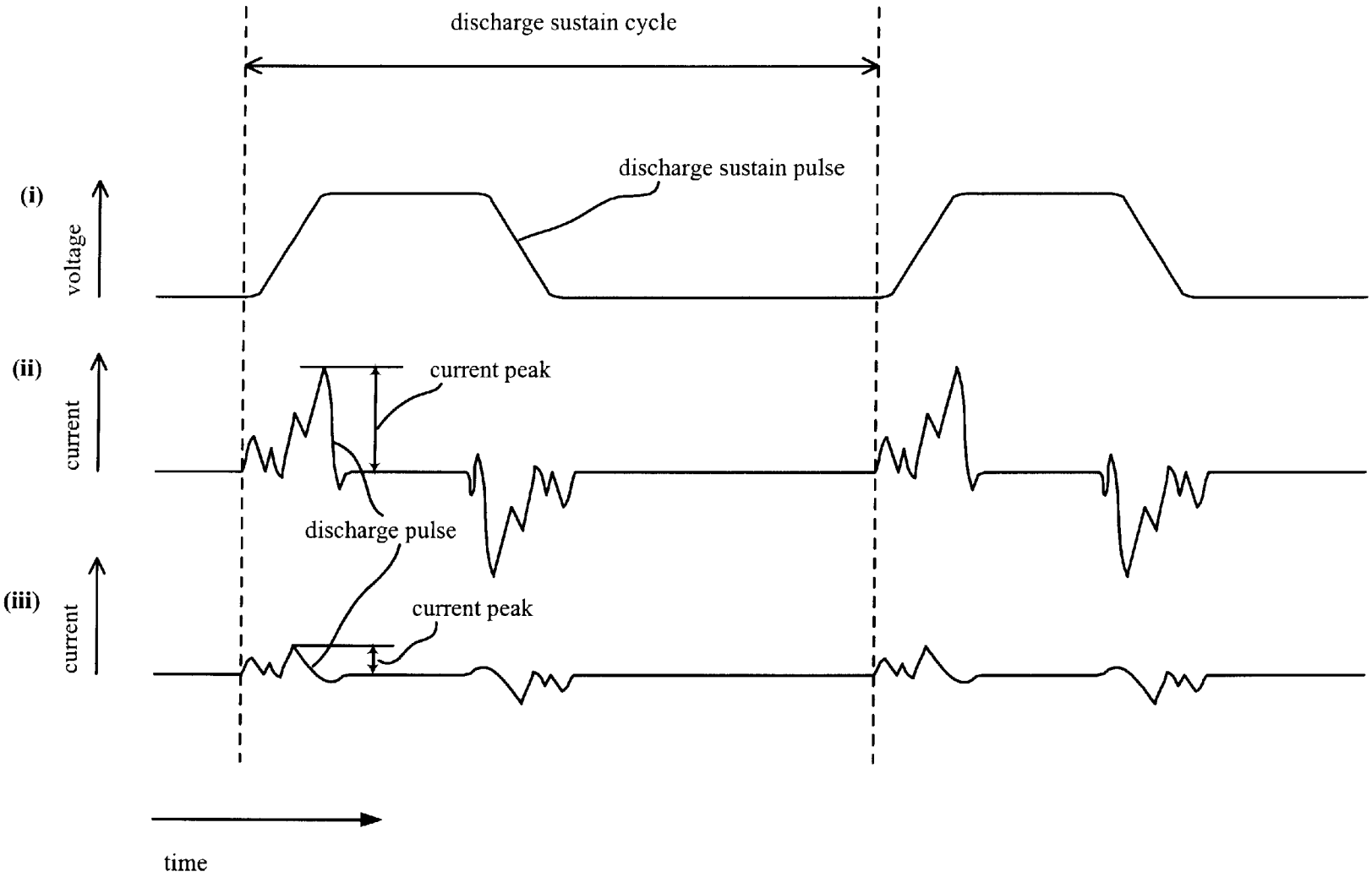
FIG. 6 is a diagram schematically showing the discharge condition of the N scan electrodes when the sustain pulses are applied to the N scan electrodes.

The invention is to provide an improved scan driving circuit for a PDP device which is a three-electrode surface-discharge AC type PDP device. The distinct feature of the common driver 24 of the invention is that: along the corresponding portion of the signal line SU between the sustain pulse source BLOCK6 and the drive stage 252*i*, the circuit block BLOCK6 does not connect in series with other functional devices, but establish a direct connection to the drive stage 252*i*. That is, the firing voltage source BLOCK3 has been disconnected from the signal line SU to avoid establishing any series connection with the sustain pulse source BLOCK6 along the SU signal line. Thereby, during the sustain discharge period, only the circuit block BLOCK6 in the Y-common driver 24 of the invention consumes most power during discharge sustain period. Further, the power consumption of the Yi-common driver 24 can be reduced to half of that of the Yi-common driver 24 in FIG. 5.

Figure 7:
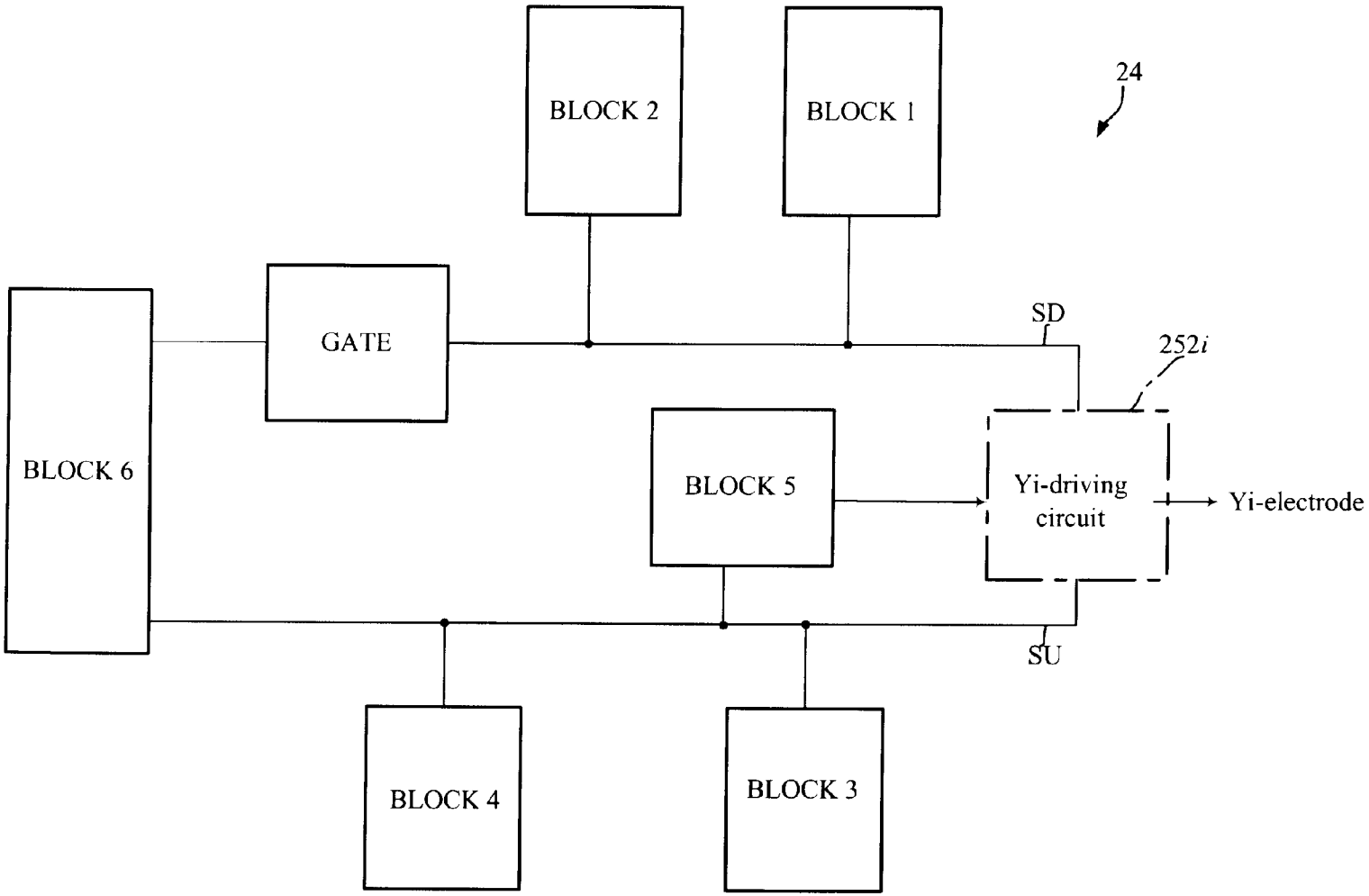
FIG. 7 is a block diagram showing the Y-common drive circuit according to the invention.

Referring to FIG. 7, a Y-common driver 24 according to an embodiment of the invention is shown. FIG. 7 is a block diagram showing essential devices of the Y-common driver 24 according to the invention. The Y-common driver 24 of the invention includes six circuit blocks (BLOCK1 to BLOCK6) and an independent gate circuit (GATE) separated from the original BLOCK3.

A first output terminal VS of the sustain pulse source BLOCK6 is electrically connected to the Yi-drive stage 252*i* via the first signal line SU. A second output terminal of the sustain pulse source BLOCK6 is electrically connected to the Yi-drive stage 252*i* via the second signal line SD. The sustain pulse source BLOCK6 is used for alternatively providing each of the N scan electrodes (Yi-electrode) a sustain pulse during the sustain discharge period. The floating voltage source BLOCK5 is electrically connected to the Yi-drive stage 252*i* for providing the floating voltage of 5V to the Yi-drive stage 252*i*.

Different from the prior art, along the first signal line SU, there is no functional device connected in series with the sustain pulse source BLOCK6 between the sustain pulse source BLOCK6 and the output driver 252*i*. As shown in FIG. 7, the firing voltage required by the Yi-drive stage 252*i* during the scan period is provided by the firing voltage source BLOCK3. In particular, the firing voltage source BLOCK3 is coupled to the first line SU in parallel, rather than connected to the first line SU in series. Although the real implemented circuit of the circuit block BLOCK3 of the present invention is different from the circuit block BLOCK3 disclosed in the prior art, but they both do provide similar function. Herein, for simplicity, we use the same reference marks BLOCK3 in FIG. 5 and FIG. 8 to denote the circuit blocks that perform the same function.

Both the output end of the scan working voltage source BLOCK1 and the reset negative voltage source BLOCK2 are coupled to the second line SD between the gate circuit (GATE) and the Yi-drive stage 252*i*. The first circuit block BLOCK1 is used to provide a working voltage for the Yi-drive stage 252*i* during the scan period, and the circuit block BLOCK2 is used to provide a negative voltage for the Yi-drive stage 252*i* during the reset period. The output end of the reset erase pulse source BLOCK4 is coupled to the first line SU. The circuit block BLOCK4 is used to provide a gently rising erase pulse for the Yi-drive stage 252*i* during the reset period. The push-pull circuit loop is formed along following path: started from the M6-VS output terminal, the signal line SU, diode D4, diode D3, signal line SD, the switch SW12, diode D1, and terminated at the switch SW1.

In order to separate both firing voltage source BLOCK3 and scan working voltage source BLOCK1 from the sustain pulse source BLOCK6, the independent gate circuit GATE (switch circuit) is connected between the sustain pulse source BLOCK6 and the Yi-driver circuit 252*i*. During the scan period, the gate circuit GATE is disconnected to break the circuit loop; and during the sustain period, the gate circuit will conduct to make the circuit loop connected.

As described above, the power consumption of the Y-common driver 24 is mostly consumed during the discharge sustain period. In the invention, the discharge pulses flow through only the circuit block BLOCK6. Clearly, the power consumed by the Y-common driver according to the invention is half of that consumed by the Y-common driver of prior art. Also taking a PDP device with 852×480 pixels as an example, the Y-common driver according to the invention consumes power of about 2 W (at all-dark screen) to 16 W (at all-bright screen).

Using the Y-common drive circuit, according to the invention, with low power consumption, heat accumulation in the PDP device can be lowered, and the design regarding heat sink for the PDP device can be alleviated.

Figure 8:
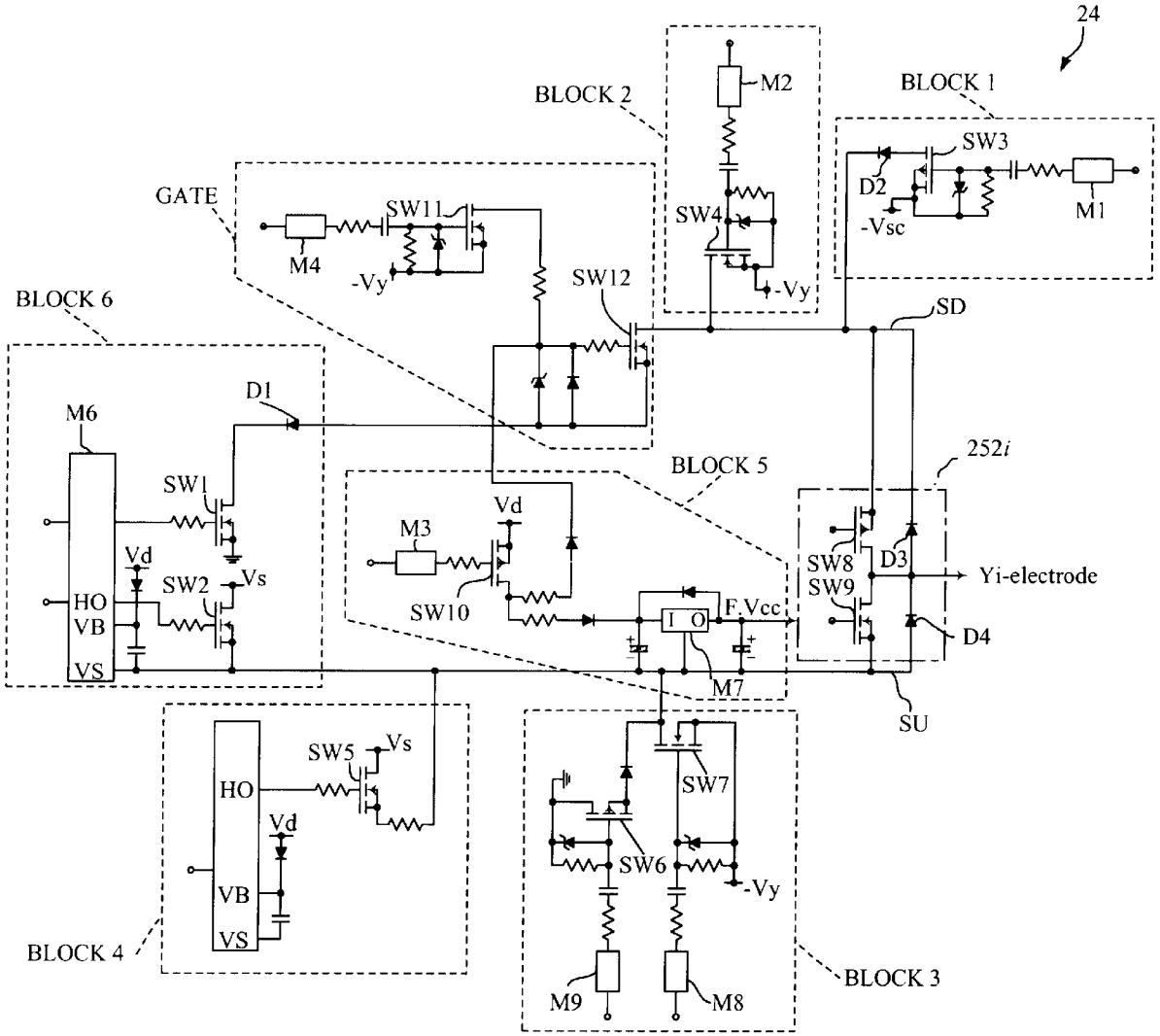
FIG. 8 is a circuit diagram showing the details of the Y-common driver of FIG. 7.

FIG. 8 is a circuit diagram showing the details of the Y-common driver 24 and Yi-drive stage 252*i* of the Y-drive circuit shown in FIG. 7. In FIG. 8, the switch elements SW1 to SW12 are MOS transistors, and MOSFET driver ICs (M1 to M6, M8, and M9) are employed for driving the MOS transistors to assure rapid switching of the switch elements. The MOSFET driver IC M6 has two output ends connected to the switch elements SW1 and SW2, respectively, to form a push-pull circuit. The MOSFET driver IC M7 is a three-terminal regulator for generating a floating voltage of 5V for the Yi-drive stage 252*i*. The switching of the switch elements SW11 and SW12 is for separating the firing voltage and working voltage of the Yi-drive stage 252*i* from each other during the scan period. As shown in FIG. 8, the circuit layout of the circuit block BLOCK3 is very different from that in FIG. 5. In an embodiment of the invention, a design of connecting several MOSFETs in parallel can be employed for the PDP device with large size to reduce the output resistance of the PDP device.

To sum up, according to the present invention, the driving circuit comprising: (1) the drive stage 252*i* which has the first driving terminal connecting the signal line SU and the second driving terminal connecting the signal line SD; (2) the switch circuit GATE which has the first switching terminal and the second switching terminal, the first switching terminal connecting the signal line SD, and the switch circuit being selectively conducted between the first switching terminal and the second switching terminal; (3) the sustain pulse source BLOCK6 with the first sustaining terminal connecting the signal line SU and the second sustaining terminal connecting the second switching terminal; (4) the scan working voltage source BLOCK1 for coupling a working voltage to the signal line SD; (5) the reset negative voltage source BLOCK2 for coupling a negative voltage to the signal line SD; (6) the firing voltage source BLOCK3 for coupling a firing voltage to the signal line SU; (7) the reset erase pulse source BLOCK4 for coupling a rising erase pulses to the signal line SU; and (8) the floating voltage source BLOCK5 for coupling a floating voltage to the signal line SU.

While the invention has been described in some preferred embodiments, it is understood that the words which have been used are words of description rather than words of limitation and that changes within the purview of the appended claims may be made without departing from the scope and spirit of the invention in its broader aspect.

What is claimed is:

1. In a plasma display panel comprising M address electrodes, N scan electrodes and N common electrodes orthogonal to the M address electrodes, said plasma display panel comprising N first driving devices, each first driving device corresponding to one of the N scan electrodes, each first driving device having a first terminal and a second terminal, a negative voltage being applied to the first terminal and rising erase pulses being applied to the second terminal during a reset period of said plasma display panel, a working voltage being applied to the first terminal and a firing voltage being applied to the second terminal during a scan period of said plasma display panel, said plasma display panel comprising a common driving circuit for providing a driving voltage, via one first driving device, to one corresponding scan electrode, said common driving circuit comprising:

gate means having a first terminal and a second terminal, the first terminal of the gate means being electrically connected to the first terminal of each first driving device;

first means for providing each first driving device with the working voltage during the scan period at an output end thereof, the output end of the first means being coupled to the first terminal of the gate means;

second means for providing each first driving device with the negative voltage during the reset period at an output end thereof, the output end of the second means being coupled to the first terminal of the gate means;

third means for providing each first driving device with the firing voltage during the scan period at an output end thereof, the output end of the third means being coupled to the second terminal of the first driving device;

fourth means for providing each first driving device with the rising erase pulses during the reset period at an output end thereof, the output end of the fourth means being coupled to the second terminal of each first driving device;

fifth means for generating a floating voltage to each first driving device;

sixth means for providing discharge sustain pulses, via the gate means, to each first driving device during a discharge sustain period of said plasma display panel, a first output terminal of the sixth means being electrically connected to the second terminal of the gate means, and a second output terminal of the sixth means being electrically connected to the second terminal of each first driving device; and wherein the gate means separates the firing voltage from the working voltage during the scan period.

2. The common driving circuit of the claim 1, wherein said plasma display panel further comprises a control circuit, and said common driving circuit outputs the driving voltage in response to a control signal from the control circuit.

3. The common driving circuit of claim 2, wherein said plasma display panel further comprises N of second driving devices, the control circuit outputs the control signal, via one second driving device, to one corresponding first driving device to switch on and off the corresponding first driving device.

4. The common driving circuit of claim 1, wherein the plasma display panel is a three-electrode surface-discharge AC type plasma display panel.

5. The common driving circuit of claim 1, where the sixth means is a push-pull circuit.

6. The common driving circuit of claim 1, wherein the fifth means is a three-terminal regulator.

7. In a plasma display panel comprising M address electrodes, N scan electrodes and common electrodes orthogonal to the M address electrodes, said plasma display panel comprising a control circuit and a scan driving circuit, the scan driving circuit being for driving the N scan electrodes in response to a control signal from the control circuit, said scan driving circuit comprising:

N first driving devices, each first driving device corresponding to one of the N scan electrodes, each first driving device having a first terminal and a second terminal, a negative voltage being applied to the first terminal and rising erase pulses being applied to the second terminal during a reset period of said plasma display panel, a working voltage being applied to the first terminal and a firing voltage being applied to the second terminal during a scan period of said plasma display panel;

N second driving devices, the control circuit outputting the control signal, via one second driving device, to one corresponding first driving device to switch on and off the corresponding first driving device;

a common driving device, responsive to the control signal from the control circuit, providing a driving voltage, via one first driving device, to one corresponding scan electrode, said common driving devices comprising:

gate means having a first terminal and a second terminal, the first terminal of the gate means being electrically connected to the first terminal of each first driving, device, first means for providing each first driving device with the working voltage during the scan period at an output end thereof, the output end of the first means being coupled to the first terminal of the gate means, second means for providing each first driving device with the negative voltage during the reset period at an output end thereof, the output end of the second means being coupled to the first terminal of the gate means;

third means for providing each first driving device with the firing voltage during the scan period at an output end thereof, the output end of the third means being coupled to the second terminal of the first driving device, fourth means for providing each first driving device with the rising erase pulses during the reset period at an output end thereof, the output end of the fourth means being coupled to the second terminal of each first driving device, fifth means for generating a floating voltage to each first driving device, sixth means for providing discharge sustain pulses, via the gate means, to each first driving device during a discharge sustain period of said plasma display panel, a first output terminal of the sixth means being electrically connected to the second terminal of the gate means, and a second output terminal of the sixth means being electrically connected to the second terminal of each first driving device; and wherein the gate means separates the firing voltage from the working voltage during the scan period.

8. The scan driving circuit of claim 7, wherein said plasma display panel is a three-electrode surface-discharge AC type plasma display panel.

9. The scan driving circuit of claim 7, wherein the sixth means is a push-pull circuit.

10. The scan driving circuit of claim 7, wherein the fifth means is a three-terminal regulator.

11. A driving circuit for driving a sustain electrode in a plasma display panel, the driving circuit comprising:

a drive stage having a first driving terminal and a second driving terminal;

a switch circuit having a first switching terminal and a second switching terminal, the switch circuit being selectively conducted between the first switching terminal and the second switching terminal, the first switching terminal being connected to the second driving terminal;

a sustain pulse source with a first sustaining terminal and a second sustaining terminal, the first sustaining terminal being connected to the first driving terminal, the second sustaining terminal being connected to the second switching terminal;

a scan working voltage source connected with the second driving terminal for coupling a working voltage to the second driving terminal;

a reset negative voltage source connected with the second driving terminal for coupling a negative voltage to the second driving terminal;

a firing voltage source connected with the first driving terminal for coupling a firing voltage to the first driving terminal;

a reset erase pulse source connected with the first driving terminal for coupling a rising erase pulses to the first driving terminal; and a floating voltage source connected with the first driving terminal for coupling a floating voltage to the first driving terminal;

wherein when the switch circuit is not conducted between the first switching terminal and the second switching terminal, the sustain pulse source is isolated from either one of the scan working voltage source and the firing voltage source.

* * * * *